US011566810B2

(12) United States Patent
Qin et al.

(10) Patent No.: US 11,566,810 B2
(45) Date of Patent: Jan. 31, 2023

(54) AIR CONDITIONER INDOOR UNIT, AND AIR CONDITIONER

(71) Applicants: GD MIDEA AIR-CONDITIONING EQUIPMENT CO., LTD., Foshan (CN); MIDEA GROUP CO., LTD., Foshan (CN)

(72) Inventors: Qiang Qin, Foshan (CN); Xiansong Wang, Foshan (CN); Xinchang Chen, Foshan (CN); Zhenmin Cui, Foshan (CN); Tao Rao, Foshan (CN)

(73) Assignees: GD MIDEA AIR-CONDITIONING EQUIPMENT CO., LTD, Foshan (CN); MIDEA GROUP CO., LTD., Foshan (CN)

( * ) Notice: Subject to any disclaimer, the term of this patent is extended or adjusted under 35 U.S.C. 154(b) by 26 days.

(21) Appl. No.: 16/732,807

(22) Filed: Jan. 2, 2020

(65) Prior Publication Data

US 2020/0141610 A1 May 7, 2020

Related U.S. Application Data

(63) Continuation of application No. PCT/CN2017/117840, filed on Dec. 21, 2017.

(30) Foreign Application Priority Data

Jul. 5, 2017 (CN) ..... 201710545667.3

(51) Int. Cl.
*F24F 13/02* (2006.01)
*F24F 13/08* (2006.01)

(52) U.S. Cl.
CPC ..... *F24F 13/02* (2013.01); *F24F 13/082* (2013.01)

(58) Field of Classification Search
CPC ..... F24F 1/0007; F24F 1/0057; F24F 13/02; F24F 13/082; F24F 13/20
(Continued)

(56) References Cited

U.S. PATENT DOCUMENTS 7,685,833 B2 * 3/2010 Ju ..... F24F 1/0057 62/262
2005/0279116 A1 * 12/2005 Park ..... F24F 13/28 62/317

(Continued)

FOREIGN PATENT DOCUMENTS

CN 103822341 A 5/2014
CN 104748238 A * 7/2015

(Continued)

OTHER PUBLICATIONS

World Intellectual Property Organization (WIPO) International Search Report for PCT/CN2017/117840 dated Apr. 9, 2018 6 Pages (Translation Included ).

(Continued)

*Primary Examiner* — Avinash A Savani
*Assistant Examiner* — Dana K Tighe
(74) *Attorney, Agent, or Firm* — Anovalaw Group PLLC

(57) ABSTRACT

An air conditioner indoor unit includes a chassis, an air duct assembly detachably connected with the chassis, a face frame including a detachment opening configured to allow the air duct assembly to pass through, a first panel configured to open or close the detachment opening, and a second panel configured to cooperate with the first panel to cover a surface of the face frame.

19 Claims, 8 Drawing Sheets

(58) Field of Classification Search
USPC ..... 454/358
See application file for complete search history.

(56) References Cited

U.S. PATENT DOCUMENTS

| | | | | |
|---|---|---|---|---|
| 2007/0261425 | A1* | 11/2007 | Yasutomi | F24F 1/0007 62/263 |
| 2009/0158765 | A1* | 6/2009 | Ooishi | F24F 13/20 62/263 |
| 2009/0183521 | A1* | 7/2009 | Shibuya | F24F 1/0007 62/259.1 |
| 2010/0287973 | A1* | 11/2010 | Son | F24F 1/0057 62/407 |
| 2013/0035028 | A1* | 2/2013 | Zhu | F24F 13/20 454/233 |
| 2013/0098094 | A1* | 4/2013 | Hankook | F24F 1/0057 62/291 |
| 2014/0360805 | A1* | 12/2014 | Berkman | H04R 1/02 181/141 |
| 2016/0033161 | A1* | 2/2016 | Koyanagi | F24F 13/20 312/236 |

FOREIGN PATENT DOCUMENTS

| | | | | | |
|---|---|---|---|---|---|
| CN | 204555252 | U | | 8/2015 | |
| CN | 204923226 | U | | 12/2015 | |
| CN | 106352523 | A | * | 1/2017 | |
| CN | 106871245 | A | * | 6/2017 | F24F 13/00 |
| CN | 106871245 | A | | 6/2017 | |
| CN | 106895491 | A | | 6/2017 | |
| CN | 107255310 | A | | 10/2017 | |
| CN | 206905239 | U | | 1/2018 | |
| CN | 207006375 | U | | 2/2018 | |
| JP | H08-296867 | A | | 11/1996 | |
| JP | H08285319 | A | | 11/1996 | |
| JP | 2003074895 | A | | 3/2003 | |
| JP | 2003307323 | A | | 10/2003 | |
| JP | 2005061745 | A | | 3/2005 | |
| JP | 2012172856 | A | | 9/2012 | |
| WO | WO-2016154955 | A1 | * | 10/2016 | F24F 11/89 |

OTHER PUBLICATIONS

The European Patent Office (EPO) Extended Search Report for EP Application No. 17916558.4 dated Apr. 24, 2020 8 Pages.

The European Patent Office (EPO) Communication from the Examining Division for EP Application No. 17916558.4 dated Nov. 18, 2020 5 Pages.

Japan Patent Office Reasons for Refusal For Japanese Application No. 2019572164 dated Feb. 9, 2021 8 Pages (including English translation).

Japan Patent Office Notice of Reasons for Refusal For Japanese Application No. 2019-572164 dated Jun. 1, 2021 8 Pages (including translation).

* cited by examiner

AIR CONDITIONER INDOOR UNIT, AND AIR CONDITIONER

CROSS-REFERENCE TO RELATED APPLICATIONS

This application is a continuation of International Application No. PCT/CN2017/117840, filed Dec. 21, 2017, which claims priority to Chinese Application No. 201710545667.3, filed Jul. 5, 2017, the entire contents of which are incorporated herein by reference.

TECHNICAL FIELD

The present disclosure relates to the technical field of air conditioners, in particular to an air conditioner indoor unit.

BACKGROUND

With the popularization of air conditioner, users have been increasingly concerned about the health problems caused by air conditioning. For an indoor unit of a split-type air conditioner, indoor air typically is blown back into the room passing in sequence through a filter, an evaporator, a fan wheel, an air duct and the like. If the above parts are not cleaned in time or thoroughly, bacteria and even mildew are easily grown, contaminating the cold air blown out by the air conditioner. However, in the assembly of the related indoor air conditioners, only the front panel covering the filter installation opening can be opened at a certain angle to take out the filter for cleaning. Other components, especially the air duct assembly, cannot be removed and cleaned by the user, due to the assembling complication. This makes the user using these indoor air conditioner suffer from health risks.

SUMMARY

The main purpose of the present disclosure is to provide an air conditioner indoor unit, which aims to improve the disassembly and assembly convenience of the air conditioner indoor unit and facilitate deep cleaning of the air conditioner indoor unit.

In order to achieve the above objective, the air conditioner indoor unit provided by the disclosure includes: a chassis, an air duct assembly detachably connected with the chassis, and forming an air duct; a face frame forming an installation opening and a detachment opening that is configured to detach the air duct assembly; a grille assembly including a grille member detachably installed at the installation opening and a filter arranged on the grille member; a first panel configured to open or close the detachment opening, and including an air outlet communicating with the air duct of the air duct assembly; and a second panel configured to cover a surface of the face frame cooperatively with the first panel.

In some embodiments, the first panel is clamped with the face frame.

In some embodiments, the first panel and the second panel are configured to cooperatively cover a front side of the face frame, the second panel being positioned above the first panel; and the first panel is detachably clamped with the face frame at a left end and a right end of the first panel.

In some embodiments, the first panel is rotatably connected with the face frame at one end of the first panel, and is openable relatively away from the face frame at another end of the first panel.

In some embodiments, the first panel and the second panel are configured to cooperatively cover a front side of the face frame, the second panel being positioned above the first panel; the second panel are rotatably connected with the face frame at an upper end of the second panel, and is openable relatively away from the face frame at a lower end of the second panel.

In some embodiments, the first panel includes a plurality of clamps protruded on an inner side of the first panel, and the face frame includes a plurality of clamping holes, the clamping holes being formed on a front side of the face frame and configured to fit with the clamps; or the face frame includes a plurality of clamps protruded on a front side of the face frame, and the first panel includes a plurality of clamping holes, the clamping holes being formed on the inner side surface of the first panel and configured to fit with the clamps.

In some embodiments, the plurality of clamps include: a first group including one or more clamps at the left end on the inner side of the first panel, and a second group including one or more clamps at the right end on the inner side of the first panel.

In some embodiments, the plurality of the clamps include: two clamps spacedly and oppositely arranged at a left end on the inner side of the first panel, and two clamps spacedly and oppositely arranged at a right end on the inner side of the first panel. Each of the clamps includes a fastening and protruding portion extending along an up-down direction at a free end of the clamps, two fastening and protruding portions at a same end being extended in an opposite direction.

In some embodiments, the second panel and the face frame are integrally formed; or the second panel is rotatably connected with the face frame at one end of the second panel, and is openable relatively away from the face frame at another end of the second panel.

In some embodiments, the grille member and the filter are integrally formed.

In some embodiments, the air conditioner indoor unit further includes an air guiding assembly, on the first panel.

In some embodiments, the air duct assembly includes a volute, the volute including: a first sliding protrusion structure at a left end of the volute, and a second sliding protrusion structure at a right end of the volute; the chassis includes: a first side fixing member arranged at a left end of the chassis, and a second side fixing member arranged at a right end of the chassis, the first side fixing members including a first sliding groove structure at a side facing to the second side fixing members, the second side fixing members including a second sliding groove structure at a side facing to the first side fixing members; the first sliding protrusion structure is engaged with the first sliding groove structure, and the second sliding protrusion structure is engaged with the second sliding groove structure.

In some embodiments, the air duct assembly further includes the air duct assembly further includes: a front water receiving plate, and a rear water receiving plate, the front water receiving plate and the rear water receiving plate being both formed on an upper part of the volute and integrally formed with the volute.

In the technical solution of the air conditioner indoor unit of the disclosure, in one aspect, since the first panel can be opened relative to the face frame to expose the detachment opening, the air duct assembly detachably connected to the chassis can be conveniently disassembled from the detachment opening. This provides great convenience for deep cleaning of the air duct, the heat exchanger and other related components. In another aspect, since the face frame is provided with an installation opening, and the grille member on which the filter is installed is detachably connected to the installation opening, the filter can also be conveniently disassembled for cleaning. The synergistic action of the aforementioned aspects improves the disassembly and assembly convenience of the air conditioner indoor unit, and facilitates the thorough and deep cleaning of the air conditioner indoor unit. This may bring benefits in reducing the potential health hazard coming from the air conditioner indoor unit.

BRIEF DESCRIPTION OF THE DRAWINGS

In order to more clearly explain the embodiment of the present disclosure, the following will briefly introduce the drawings referenced to in the description of the embodiments. Obviously, the drawings in the following description are only some embodiments of the present disclosure. For those having ordinary skill in the art, other drawings can be obtained according to the structure shown in these drawings without any creative effort.

DESCRIPTION OF REFERENCE NUMERALS

Figure 1:
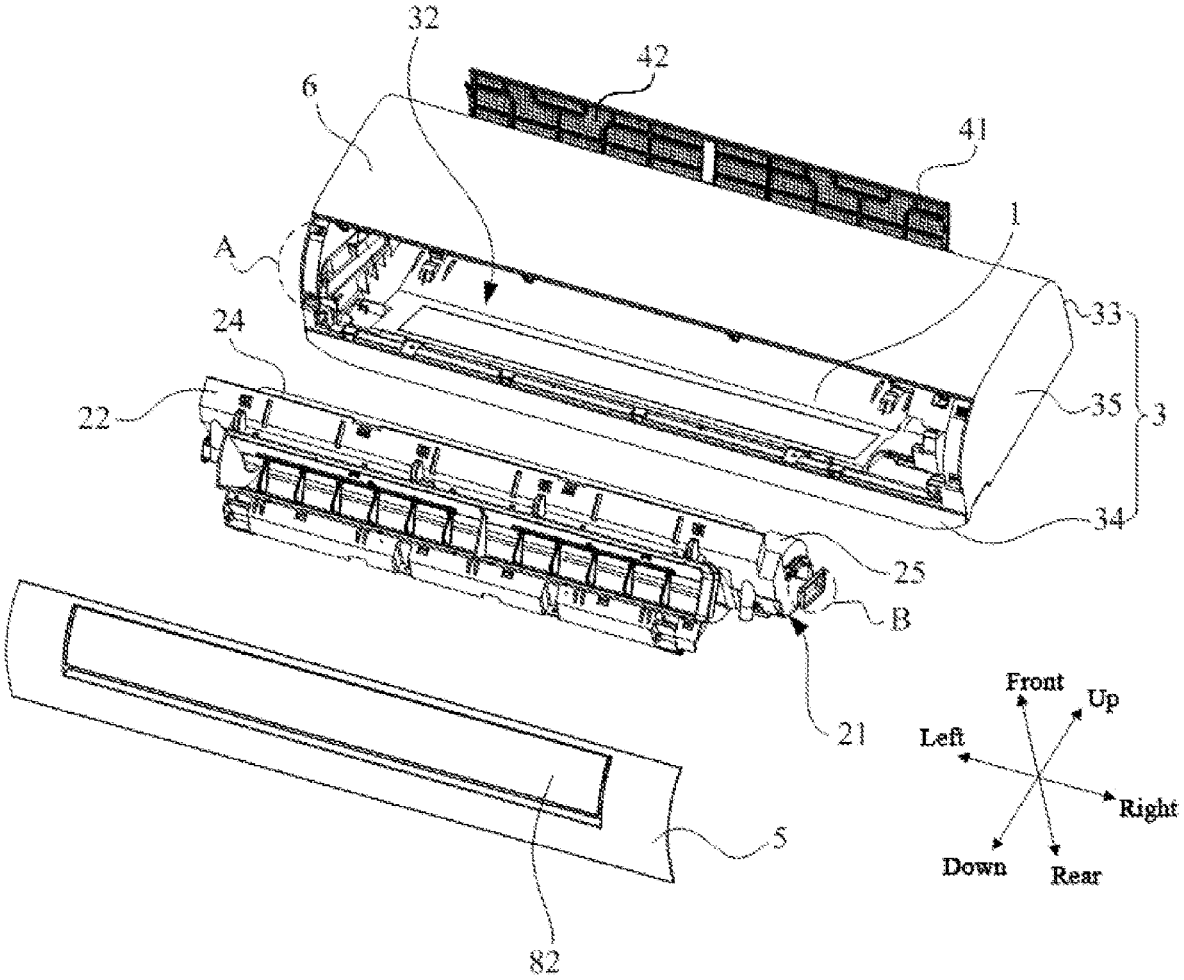
FIG. 1 is an exploded view of an air conditioner indoor unit according to an embodiment of the present disclosure.

| Reference Numeral | Name | Reference Numeral | Name |
|---|---|---|---|
| 1 | Chassis | 3 | Face frame |
| 5 | First panel | 6 | Second panel |
| 8 | Air guiding assembly | 11 | Side fixing member |
| 21 | Volute | 22 | Front water receiving tray |
| 24 | Fan wheel | 25 | Fan wheel motor |
| 32 | Detaching mouth | 33 | Upper support |
| 34 | Lower frame | 35 | Side connector |
| 36 | Clamping hole | 41 | Grille member |
| 51 | Air outlet | 52 | Fastener |
| 81 | Drive motor | 82 | Air guiding plate |
| 111 | Connection member | 112 | Sliding groove |
| 211 | Sliding protrusion structure | 211a | Sliding block |
| 211b | Limiting flange | 341 | Protruding plate |
| 521 | Fastening and protruding portion | | |

The implementation, functional features and advantages of the present disclosure will be further described with reference to the accompanying drawings with the embodiments.

DETAILED DESCRIPTION OF THE EMBODIMENTS

As following, the technical solution in the embodiments of the present disclosure will be described clearly with reference to the drawings in the embodiments of the present disclosure. Obviously, the described embodiments are only some of the embodiment of the present disclosure, not all of the embodiments. Based on the embodiments in the present disclosure, all other embodiments perceived by those ordinary skills in the art without creative effort should fall within the scope of the present disclosure.

It should be noted that directional indications (such as up, down, left, right, front, back, etc.) used in the embodiments of the present disclosure are only for explaining the relative positional relationship and movement between the components in a certain posture (as shown in the drawings), and if the specific posture changes, the directional indications will change accordingly.

In addition, terms such as "first" and "second" used in the embodiments of this disclosure are for descriptive purposes only and cannot be understood as indicating or implying their relative importance or implicitly indicating the number of indicated technical features. Thus, features associated with "first" and "second" may explicitly or implicitly include at least one of the features. In addition, the technical solutions between the various embodiments may be combined with each other, as long as they do not conflict with each other.

The present disclosure provides an air conditioner indoor unit.

Referring to FIG. 1, in one embodiment of the present disclosure, the air conditioner indoor unit is specifically a wall-mounted air conditioner indoor unit. The air conditioning indoor unit comprises a chassis 1, an air duct assembly (not labeled), a face frame 3, a grille assembly (not labeled), a first panel 5 and a second panel 6. The air duct assembly is detachably connected with the chassis 1. The face frame 3 is provided with an installation opening (not labeled) and a detachment opening 32 for removing the air duct assembly. The grille assembly includes a grille member 41 detachably mounted at the installation opening and a filter 42 provided at the grille member 41. The first panel 5 is configured to open or close the detachment opening 32, and the first panel 5 is provided with an air outlet 51 connected with the air duct formed by the air duct assembly. The second panel 6 and the first panel 5 are engaged to cover a surface of the face frame 3.

It should be appreciated that in the present embodiment, the face frame 3 includes an upper support 33, a lower frame 34, and two opposite side connectors 35 located between the upper support 33 and the lower frame 34. The installation opening is formed between the upper support 33 and the lower frame 34. The detachment opening 32 is formed in the lower frame 34. The grille member 41 is detachably installed at the upper support 33. When the air conditioner indoor unit is in actual use, air flows through the grille member 41, the filter 42, the heat exchanger (not shown), the air duct assembly and the air outlet 51 in sequence and is blown out after being cooled.

In the present embodiment, in one aspect, since the first panel 5 can be opened relative to the face frame 3 to expose the detachment opening 32, the air duct assembly detachably connected to the chassis 1 can be conveniently removed through the detachment opening 32. This provides great convenience for deep cleaning of the air duct, the heat exchanger and other related components. In another aspect, since the face frame 3 is provided with an installation opening, and the grille member 41 on which the filter 42 is installed is detachably connected to the installation opening, the filter 42 can also be conveniently removed for cleaning. The synergistic action of the aforementioned aspects improves the disassembly and assembly convenience of the air conditioner indoor unit, and facilitates the thorough and deep cleaning of the air conditioner indoor unit. This may bring benefits in reducing the potential health hazard coming from the air conditioner indoor unit.

Referring to FIGS. 1 to 5, in the present embodiment, the first panel 5 is optionally detachably fastened with the face frame 3. Specifically, the first panel 5 and the second panel 6 cooperatively cover the front side of the face frame 3, and the second panel 6 is located above the first panel 5. The left and right ends of the first panel 5 are detachably fastened with the face frame 3. In some embodiments, the first panel 5 can be detachably clamped with the face frame 3 at the upper and lower ends or the peripheral edges of the first panel 5. In the present embodiment, the arrangement of the first panel 5 being detachably clamped with the face frame 3 at the left and right ends of the first panel 5 can simplify the structure and avoid interference during removal of the air duct assembly.

Figure 2:
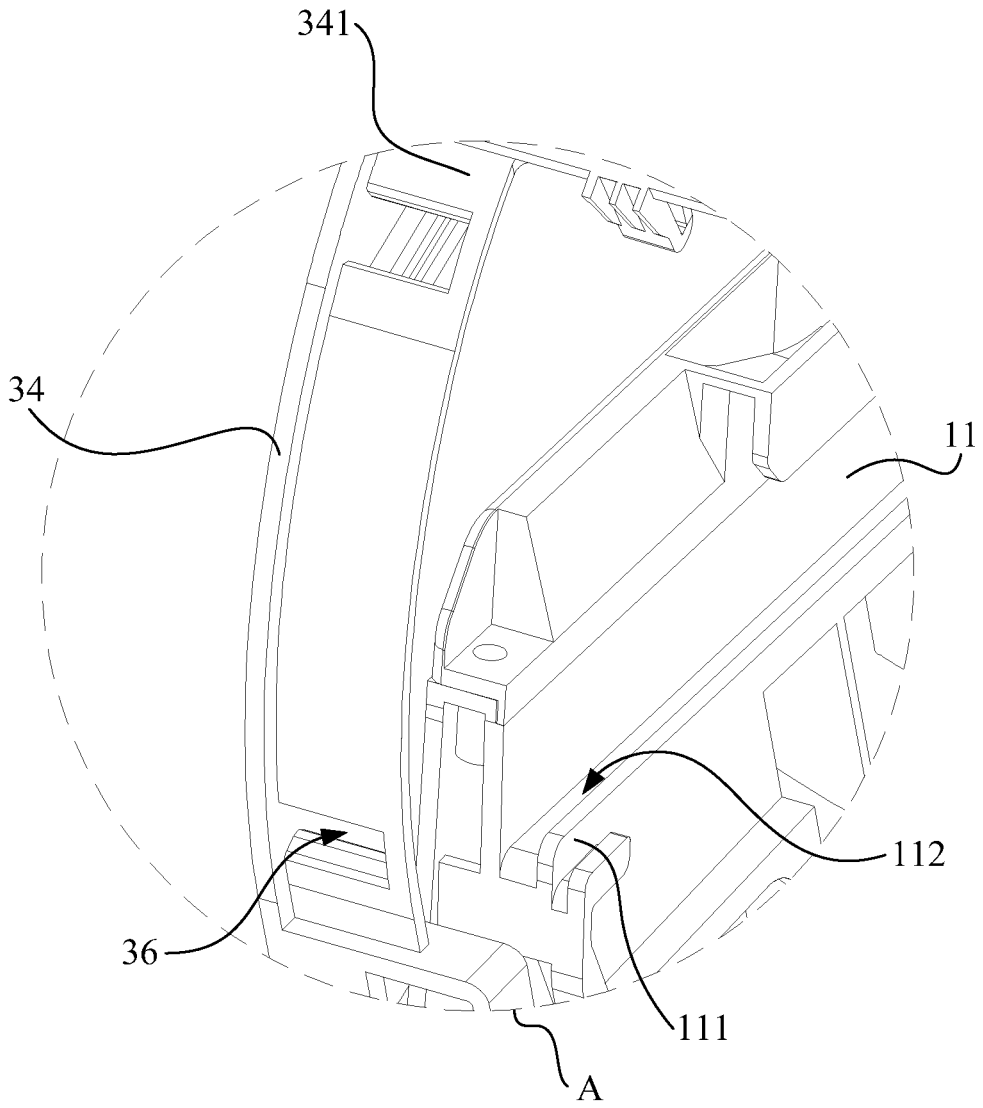
FIG. 2 is an enlarged schematic view of portion A in FIG. 1.
Figure 4:
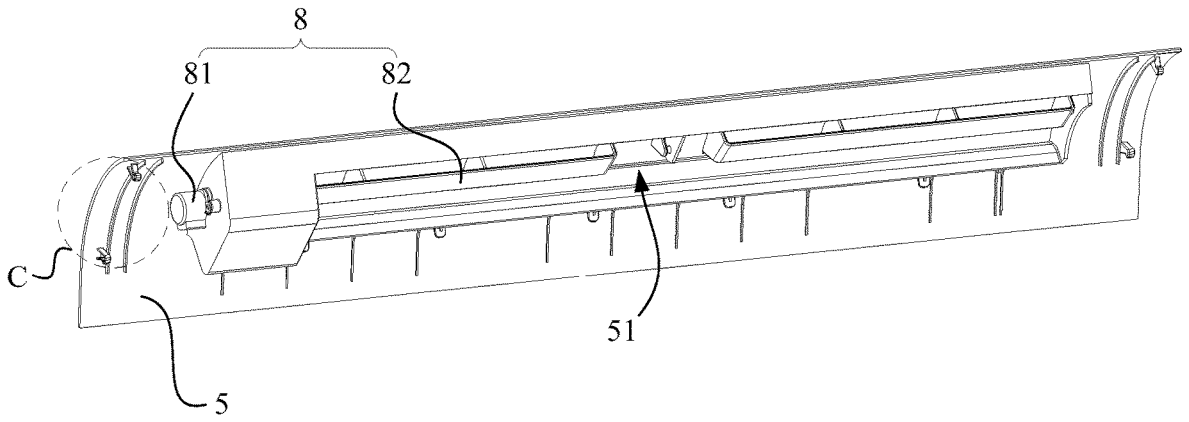
FIG. 4 is a schematic structural view of the first panel in FIG. 1.
Figure 5:
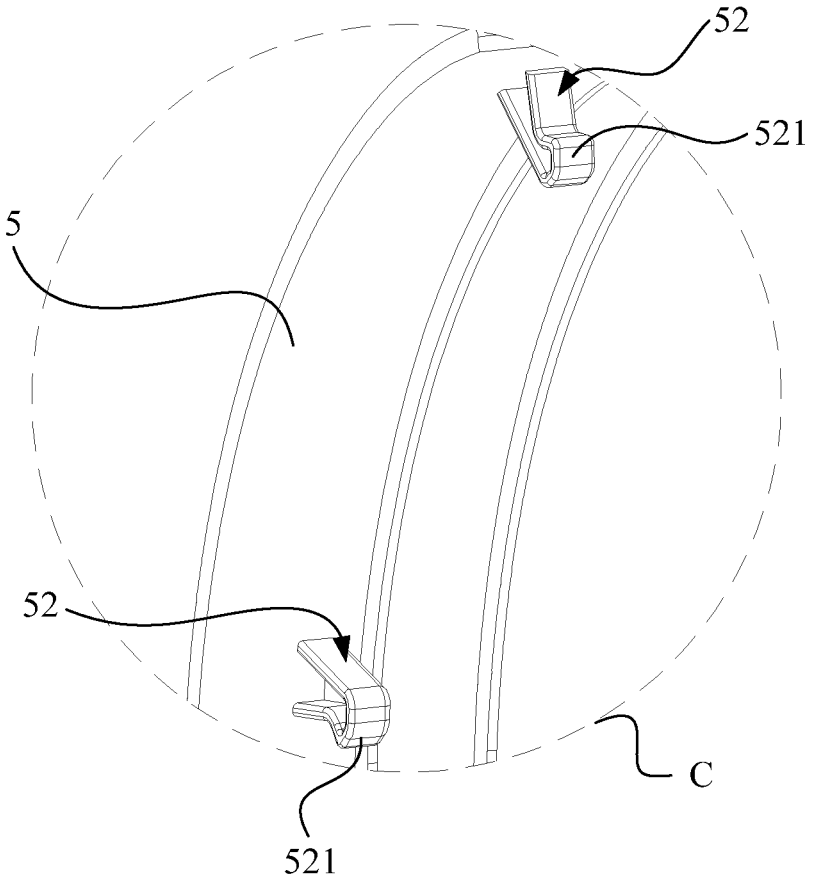
FIG. 5 is an enlarged schematic view of portion C in FIG. 4.

Further, referring to FIGS. 2, 4 to 5, in the present embodiment, the inner side of the first panel 5 is provided with a plurality of fasteners 52 protruding from the inner side, and the front side of the face frame 3 is provided with clamping holes 36 into which the fasteners 52 can be fastened. As such, the engagement of the first panel 5 and the face frame 3 can be implemented by fastening the fasteners 52 into the corresponding clamping holes 36. When the first panel 5 needs to be removed, only the fasteners 52 need to be separated from the clamping holes 36. Specifically, a plurality of fasteners 52 are provided and are respectively arranged on the inner sides at the left and right ends of the first panel 5. The lower frame 34 is extending inward at its left and right edges to form a protruding plate 341. The protruding plate 341 is provided with clamping holes 36, i.e., the clamping holes 36 are arranged on the left and right sides of the detachment opening 32 to avoid interference to the removal of the air duct assembly. The present disclosure is not limited to the aforementioned arrangement. The fastener 52 may also be provided at the front side of the face frame 3. Accordingly, the clamping hole 36 is provided at the inner side of the first panel 5. In addition, the fastener 52 is not limited to the clamping hole 36, and may be of a structure such as a clamping seat.

In some embodiments, in order to make the structure simpler without influencing the fastening firmness, two fasteners 52 that are arranged spaced apart from each other are provided at the inner side of each of the left and right ends of the first panel 5. Each of the fasteners 52 includes a fastening and protruding portion 521 extending along an up-down direction at a free end of the fastener 52, and the fastening and protruding portions 521 at a same end of the first panel 5 are extending in opposite directions. As shown in FIG. 5, the two fasteners 52 located on the same side are spaced apart from each other in the up-down direction. The fastener 52 on the upper side is disposed adjacent to the upper end of the first panel 5, and the fastening and protruding portion 521 thereof is extending upward. The fastening and protruding portion 521 of the fastener 52 located on the lower side extends downward. As such, when the fastener 52 is inserted into the clamping hole 36, the fastening and protruding portion 521 abuts against the inner side of the edge of the clamping hole 36, thereby realizing the limit connection in the front-rear direction to the first panel 5. Further, the arrangement of the fastening and protruding portions 521 of the upper and lower fasteners 52 in opposite extending directions can limit the first panel 5 in the up-down direction.

Referring to FIGS. 1 and 4, in the present embodiment, the air conditioner indoor unit further includes an air guiding assembly 8 installed on the first panel 5. Specifically, the air guiding assembly 8 includes an air guiding plate 82 and a drive motor 81 for driving the air guiding plate 82 to rotate. The air guiding plate 82 is internally arranged in the air outlet 51, and the left and right ends of the air guiding plate 82 are respectively rotatably connected with the first panel 5, and one end of the air guiding plate 82 is connected with the drive motor 81. The drive motor 81 is fixed to the inner side of the first panel 5 and located at one side of the air outlet 51 in the left-right direction. It can be appreciated that when the first panel 5 is opened relative to the face frame 3 to expose the detachment opening 32, the air guiding assembly 8 installed on the first panel 5 is also opened accordingly. The air guiding assembly 82 and the like can be conveniently cleaned.

Figure 3:
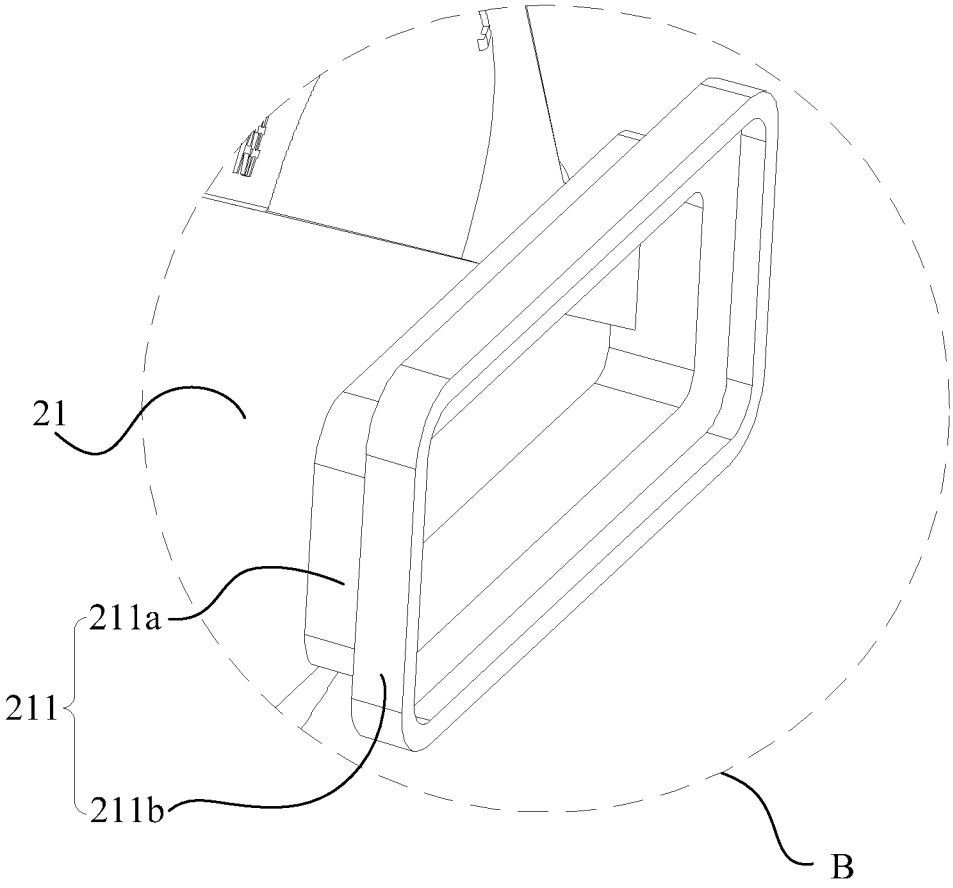
FIG. 3 is an enlarged schematic view of portion B in FIG. 1.

Referring to FIGS. 1 to 3, in the present embodiment, further, the air duct assembly includes a volute 21, the chassis 1 is provided with side fixing members 11 at the respective left and right ends of the chassis 1. The two opposite sides of the two side fixing member 11 are respectively provided with sliding groove structures. Sliding convex structures 211 are provided at the left and right ends of the volute 21, respectively, to slidably engage with the sliding groove structures. The air duct assembly can slide out of the chassis 1 very conveniently. However, the present disclosure is not limited to the aforementioned arrangement, and the sliding protrusion structures 211 may be respectively provided at the two side fixing members 11, and correspondingly, the sliding groove structures are provided at the left and right side ends of the volute 21. Specifically, two side plates are provided at the left and right ends of the volute 21, respectively. The outer side of a side plate protrudes outward to form a sliding block 211*a*. The periphery of the free end of the sliding block 211*a* extends outward along the circumferential direction to form a limiting flange 211*b*. The inner side of the side fixing part 11 protrudes inwards along the left-right direction to form a connection member 111, which is provided with a sliding groove 112 with an upper opening and its length extending along the front-back direction. During the sliding-in and sliding-out process of the air duct assembly, the bottom end of the sliding block 211*a* is in sliding fit with the sliding groove 112, and the inner side of the limiting flange 211*b* is in sliding fit with the surface of the connection member 111 facing the fixing part 11 on the other side. In some embodiments, the sliding block 211*a* is hollow to save material.

In addition, the air duct assembly further comprises a front water receiving plate 22 and a rear water receiving plate (not shown), in which the front water receiving plate 22 and the rear water receiving plate are both formed on the upper part of the volute 21 and are integrally formed with the volute 21. It can be appreciated that when the air duct assembly can be detached from the chassis 1, the front water receiving plate 22 and the rear water receiving plate integrated with the volute 21 can also be separated from the chassis 1, thereby facilitating cleaning of these components. In addition, the fan wheel 24 of the air conditioner indoor unit and the fan wheel motor 25 for driving the fan wheel 24 are also arranged at the upper part of the volute 21 and are positioned between the front water receiving plate 22 and the rear water receiving plate. The fan wheel 24 and the fan wheel motor 25 can also be removed together with air duct assembly, thus facilitating the maintenance and cleaning of these two components.

Figure 6:
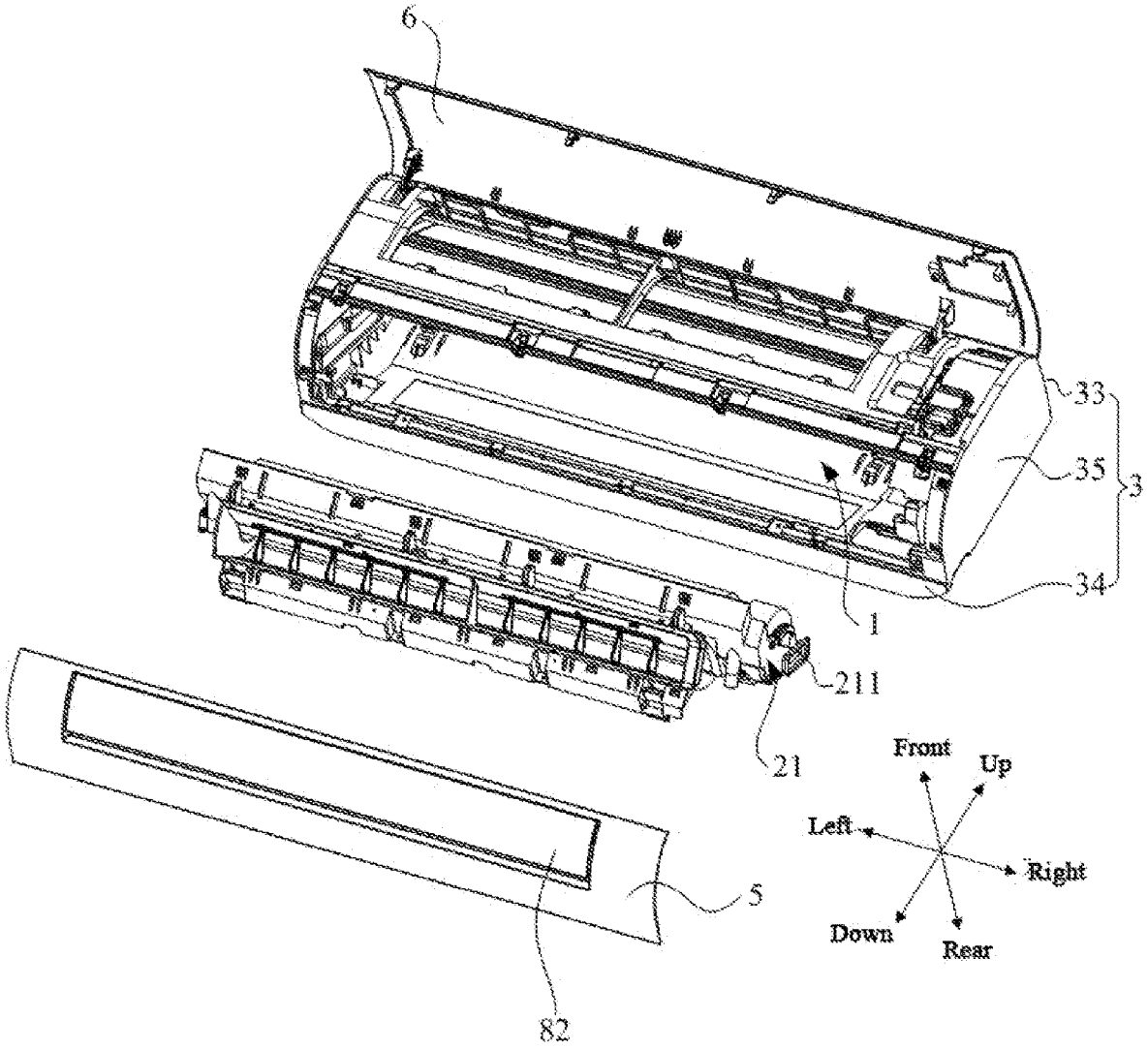
FIG. 6 is an exploded view of an air conditioner indoor unit according to another embodiment of the present disclosure.

In the embodiments described above, the first panel 5 is detachably fastened with the face frame 3. The second panel 6 is fixedly connected with the face frame 3 and is optionally integrally arranged. Further, the installation opening of the face frame 3 extends from the front side of the face frame 3 to the upper support 33, and the installation opening at the upper support 33 is the air inlet of the air conditioner indoor unit. The grille member 41 is provided in the air inlet and detachably clamped with the air inlet. Specifically, the grille member is provided with a plurality of fixing fasteners for clamping with the upper support. The fixing fasteners are optionally respectively arranged on the left and right sides of the grille member. The filter 42 is arranged on the grille member 41 and can be detached with the grille member 41. Specifically, the grille member 41 is optionally integrally formed with the filter 42. The technical solution of the present disclosure is not limited to the aforementioned arrangement. In the embodiment shown in FIG. 6, the first panel 5 is detachably fastened with the face frame 3, and the second panel 6 located above the first panel 5 can be rotatably opened relative to the face frame 3. Specifically, the upper end of the second panel 6 is rotatably connected with the face frame 3, and the lower end of the second panel 6 can be opened in a direction away from the face frame 3.

Figure 7:
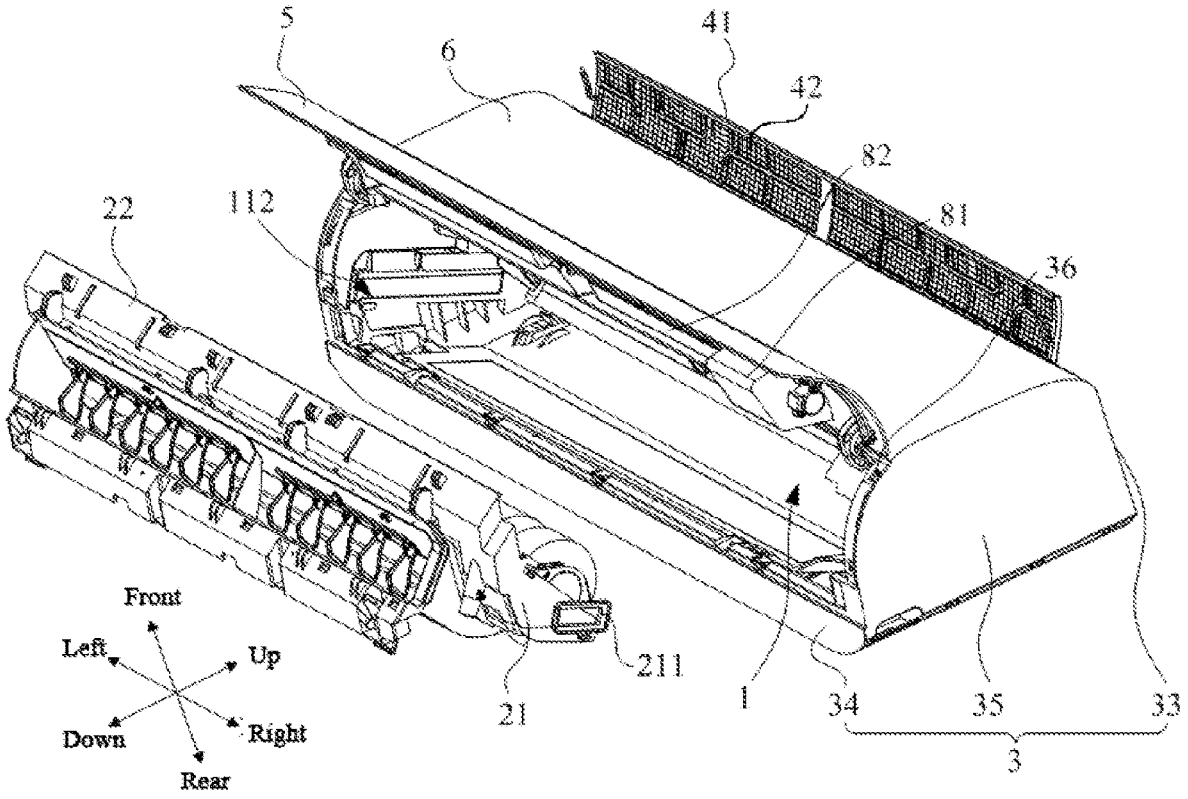
FIG. 7 is an exploded view of an air conditioner indoor unit according to another embodiment of the present disclosure.
Figure 8:
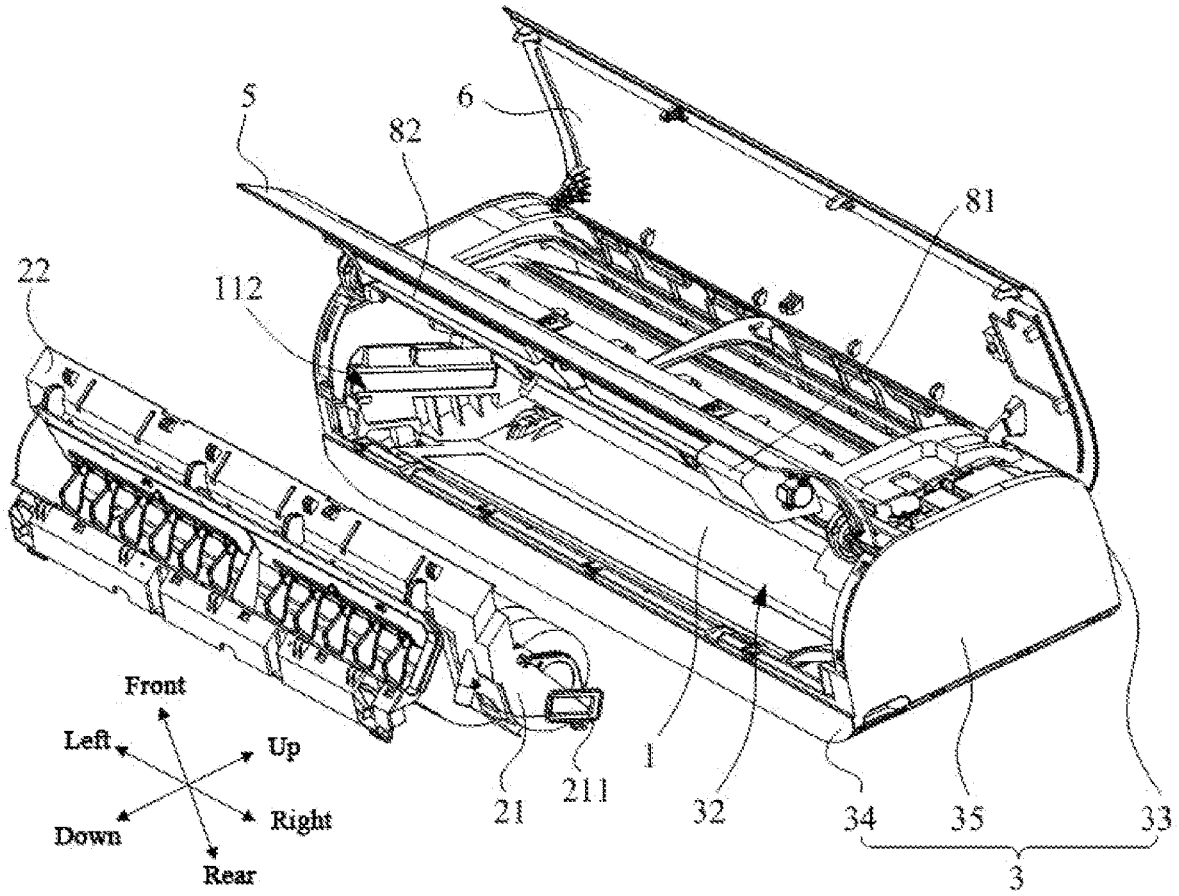
FIG. 8 is an exploded view of an air conditioner indoor unit according to another embodiment of the present disclosure.

In addition, in the embodiments shown in FIG. 7 and FIG. 8, the opening or closing of the opening 32 of the first panel 5 can be realized by rotation, i.e., one end of the first panel 5 is rotatably connected with the face frame 3, and the other end of the first panel 5 can be opened in a direction away from the face frame 3. Specifically, in the embodiment shown in FIG. 7, the upper end of the first panel 5 is rotatably connected with the face frame 3, and the lower end of the first panel 5 can be opened relatively away from the face frame 3. Additionally, the second panel 6 is fixedly connected with the face frame 3 and may be integral with the face frame 3 as one integral structure. The filter 42 is arranged at the grille member 41 and can be detached along with the grille member 41. The embodiment shown in FIG. 8 differs from the embodiment shown in FIG. 7 in that, in the embodiment shown in FIG. 8, the upper end of the second panel 6 is rotatably connected with the face frame 3, and the lower end of the second panel 6 can be opened relatively away from the face frame 3. It should also be noted that based on the technical solution of the present disclosure, the removal of the filter 42 can be performed before the first panel 5 is opened.

The aforementioned are only some embodiments of the present disclosure and are not intended to limit the scope of the present disclosure. Any equivalent structural modification made by using the description and drawings of the present disclosure or direct/indirect application in other related technical fields under the concept of the present disclosure shall be included in the scope of the present disclosure.

What is claimed is:

1. An air conditioner indoor unit comprising:

a chassis;

an air duct assembly detachably connected with the chassis;

a face frame including a detachment opening configured to allow the air duct assembly to pass through, an air inlet being arranged at a first side of the face frame;

a grille assembly arranged at the first side of the face frame;

a first panel arranged at a second side of the face frame opposite to the first side and including an air outlet, the first panel being configured to cover the detachment opening once the first panel is closed or completely expose the detachment opening once the first panel is opened to allow the air duct assembly to pass through, an upper end of the first panel being rotatably connected with the face frame, and a lower end of the first panel being movable relatively away from the face frame; and a second panel configured to cooperate with the first panel to cover a surface of the face frame;

wherein:

the air duct assembly is located between the chassis and the face frame, and in a space enclosed by the chassis and the face frame; and in a working state of the air conditioner indoor unit, air flows into the air conditioner indoor unit through the grille assembly, and flows out of the air conditioner indoor unit through the air outlet.

2. The air conditioner indoor unit of claim 1, wherein:

the grille assembly includes a grille member and a filter arranged at the grille member;

wherein:

the face frame further includes an installation opening; and the grille member is arranged in the installation opening.

3. The air conditioner indoor unit of claim 2, wherein the grille member and the filter are integrally formed as one integral structure.

4. The air conditioner indoor unit of claim 1, wherein the air outlet is in communication with an air duct formed by the air duct assembly.

5. The air conditioner indoor unit of claim 1, wherein the first panel is clamped with the face frame.

6. The air conditioner indoor unit of claim 5, wherein a left end and a right end of the first panel are detachably clamped with the face frame.

7. The air conditioner indoor unit of claim 5, wherein:

the first panel includes a plurality of clamps protruding from an inner side of the first panel; and the face frame includes a plurality of clamping holes formed at a front side of the face frame and configured to fit with the clamps.

8. The air conditioner indoor unit of claim 7, wherein the plurality of clamps include:

one or more first clamps at the inner side of a left end of the first panel; and one or more second clamps at the inner side of a right end of the first panel.

9. The air conditioner indoor unit of claim 7, wherein:

the plurality of the clamps include:

two first clamps oppositely arranged at the inner side of a left end of the first panel and spaced apart from each other; and two second clamps oppositely arranged at the inner side of a right end of the first panel and spaced apart from each other;

each of the two first clamps and the two second clamps includes a fastening and protruding portion extending along an up-down direction at a free end of the clamp; and the fastening and protruding portions of the two first clamps extend in opposite directions, and the fastening and protruding portions of the two second clamps extend in opposite directions.

10. The air conditioner indoor unit of claim 5, wherein:

the face frame includes a plurality of clamps protruding from a front side of the face frame, and the first panel includes a plurality of clamping holes formed at an inner side surface of the first panel and configured to fit with the clamps.

11. The air conditioner indoor unit of claim 1, wherein:

the second panel is positioned above the first panel; and the first panel and the second panel are configured to cooperate with each other to cover a front side of the face frame.

12. The air conditioner indoor unit of claim 11, wherein:

an upper end of the second panel is rotatably connected with the face frame; and a lower end of the second panel is movable relatively away from the face frame.

13. The air conditioner indoor unit of claim 1, wherein the second panel and the face frame are integrally formed as one integral structure.

14. The air conditioner indoor unit of claim 1, wherein the second panel is rotatably connected with the face frame at one end of the second panel, and is openable relatively away from the face frame at another end of the second panel.

15. The air conditioner indoor unit of claim 1, further comprising:

an air guiding assembly at the first panel.

16. The air conditioner indoor unit of claim 1, wherein:

the air duct assembly includes a volute including:

a first sliding protrusion structure at a left end of the volute; and a second sliding protrusion structure at a right end of the volute;

the chassis includes:

a first side fixing member protruding from a left end of the chassis and including a first sliding groove structure at a side of the first side fixing member facing a right end of the chassis; and a second side fixing member protruding from the right end of the chassis and including a second sliding groove structure at a side of the second side fixing member facing the first side fixing members; and the first sliding protrusion structure is engaged with the first sliding groove structure, and the second sliding protrusion structure is engaged with the second sliding groove structure.

17. The air conditioner indoor unit of claim 16, wherein the air duct assembly further includes a front water receiving plate formed at an upper part of the volute and integrally formed with the volute as one integral structure.

18. An air conditioner indoor unit comprising:

a chassis;

an air duct assembly detachably connected with the chassis;

a face frame including a detachment opening configured to allow the air duct assembly to pass through;

a first panel configured to cover the detachment opening once the first panel is closed or completely expose the detachment opening once the first panel is opened to allow the air duct assembly to pass through, an upper end of the first panel being rotatably connected with the face frame, and a lower end of the first panel being movable relatively away from the face frame; and a second panel configured to cooperate with the first panel to cover a surface of the face frame;

wherein:

the air duct assembly is located between the chassis and the face frame, and in a space enclosed by the chassis and the face frame;

the first panel is clamped with the face frame and includes a plurality of clamps protruding from an inner side of the first panel, the plurality of clamps including:

two first clamps oppositely arranged at the inner side of a left end of the first panel and spaced apart from each other; and two second clamps oppositely arranged at the inner side of a right end of the first panel and spaced apart from each other;

each of the two first clamps and the two second clamps includes a fastening and protruding portion extending along an up-down direction at a free end of the clamp;

the fastening and protruding portions of the two first clamps extend in opposite directions, and the fastening and protruding portions of the two second clamps extend in opposite directions; and the face frame includes a plurality of clamping holes formed at a front side of the face frame and configured to fit with the clamps.

19. An air conditioner indoor unit comprising:

a chassis;

an air duct assembly detachably connected with the chassis;

a face frame including a detachment opening configured to allow the air duct assembly to pass through;

a first panel configured to cover the detachment opening once the first panel is closed or completely expose the detachment opening once the first panel is opened to allow the air duct assembly to pass through, an upper end of the first panel being rotatably connected with the face frame, and a lower end of the first panel being movable relatively away from the face frame; and a second panel configured to cooperate with the first panel to cover a surface of the face frame;

wherein:

the air duct assembly is located between the chassis and the face frame, and in a space enclosed by the chassis and the face frame;

the face frame includes a plurality of clamps protruding from a front side of the face frame; and the first panel is clamped with the face frame and includes a plurality of clamping holes formed at an inner side surface of the first panel and configured to fit with the clamps.

* * * * *